United States Patent [19]

Sackl et al.

[11] 4,121,629

[45] Oct. 24, 1978

[54] MULTISPOT WELDING MACHINE

[75] Inventors: Alois Sackl, Liezen; Josef Ritter; Klaus Ritter; Gerhard Ritter, all of Graz, Austria

[73] Assignee: EVG Entwicklungs- u. Verwertungs GmbH., Graz, Austria

[21] Appl. No.: 771,267

[22] Filed: Feb. 23, 1977

[30] Foreign Application Priority Data

Feb. 24, 1976 [AT] Austria ..... 1326/76

[51] Int. Cl.[2] ..... B21F 27/10

[52] U.S. Cl. ..... 140/112; 140/9

[58] Field of Search ..... 140/3 R, 9, 112; 29/452; 219/56, 58

[56] References Cited

U.S. PATENT DOCUMENTS

| | | | |
|---|---|---|---|
| 1,922,270 | 8/1933 | Southwell et al. | 140/112 |
| 2,077,061 | 4/1937 | White | 140/112 |

*Primary Examiner*—Lowell A. Larson

*Attorney, Agent, or Firm*—Ernest F. Marmorek

[57] ABSTRACT

A multispot welding machine for producing a mesh web from arrays of wire running skew to the longitudinal direction of the web and crossing one another has two endless circulating feeders which carry deflector-pins and each of which has a working run defining a different one of the edges of the mesh web to be produced, a wire-layer which is movable to and fro across the feeders and arranged to lay a number of wires alternately about a corresponding number of deflector-pins on the working runs of the two feeders, and a welding zone having means for welding the wires together at their crossover points. The endless feeders circulate in a common plane which is parallel with the plane of production of the web, the deflector-pins project substantially perpendicularly from the common plane, and the working runs of the two feeders have in the neighbourhood of the welding zone a greater separation from one another than before and beyond the zone.

6 Claims, 7 Drawing Figures

MULTISPOT WELDING MACHINE

Figure 1:
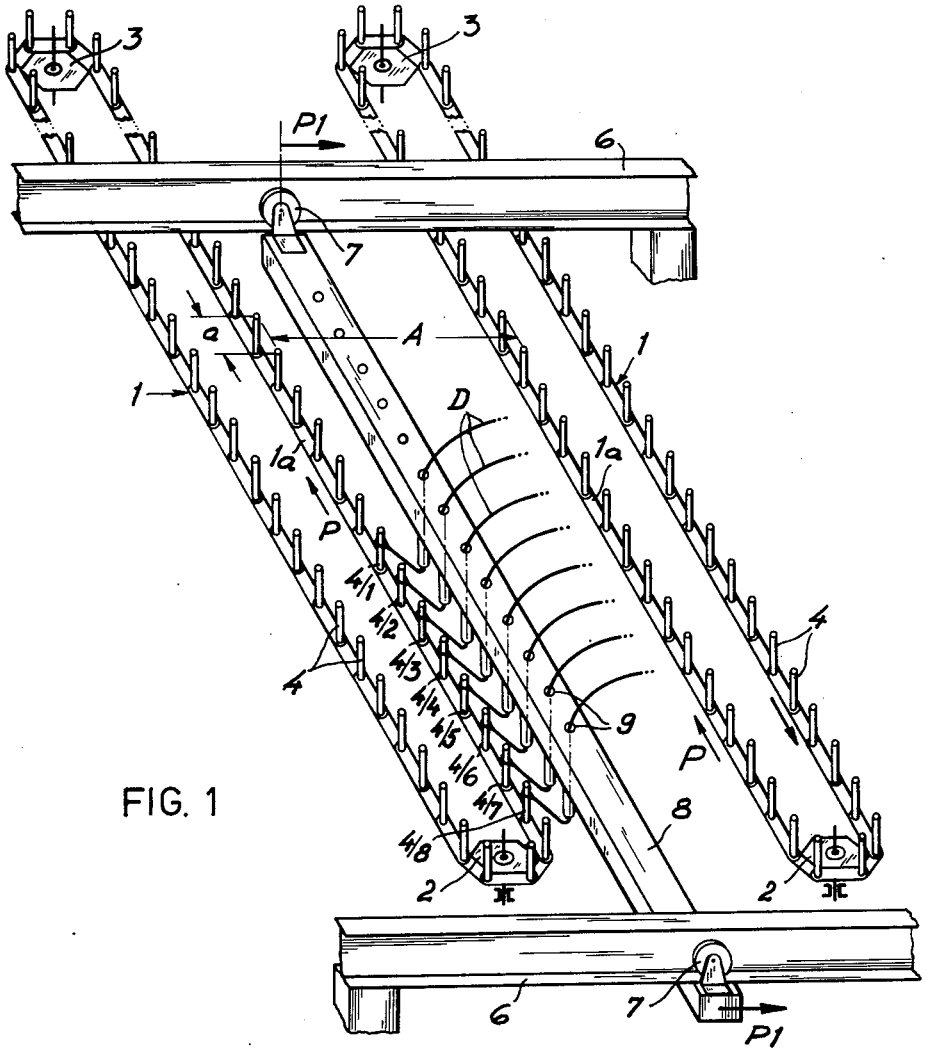

The invention refers to a multispot welding machine for producing a mesh web from arrays of wires running skew to the longitudinal direction of the web and crossing one another, the machine having two endless circulating feeders, such as belts or chains, which carry deflector-pins and each of which has a working run defining a different one of the edges of the mesh web to be produced, a wire-layer which is movable to and fro across the feeders and arranged to lay a number of wires alternately about a corresponding number of deflector-pins on the working runs of the two feeders, and a welding zone having means for welding the wires together at their crossover points. Such a machine is hereinafter referred to as of the kind described.

In the case of a machine of this kind, known from U.S. Pat. No. 1,922,270, the endless feed-chains carrying the deflector-pins describe orbits which lie perpendicular to the plane of production of the mesh, and the deflector-pins have a form of parts with hooked ends, which lie in a plane parallel with the orbital plane of the feed-chains. The wires are looped round these deflector-pins in a zigzag by the wire-layer being moved to and fro, so that they cross one another and can be welded at the points of cross. The described laying of the wires drawn from reels results inevitably in a relatively loose pattern of the wires, wherefor the separation between the rows of deflector-pins which define the edges of the mesh web, in the case of the known machine is positively increased during their movement through the welding zone in order to stretch the wires taut during welding and thus bring them exactly into the correct mutual position. The necessary shift of the deflector-pins in the welding zone is enabled by these pins being mounted in slides which are guided to be able to be displaced tranversely to the feed-chains and by a curved track being provided by which the necessary movement of displacement transversely to their feeding motion is imposed upon the slides and hence the deflector-pins in the neighbourhood of the welding zone. Beyond the welding zone the stretching force exerted by the deflector-pins upon the already welded mesh is removed again by shifting the slides carrying the deflector-pins in the opposite direction, so that the finished mesh can easily be released from the deflector-pins.

The arrangement necessary in the case of the known machine whereby the deflector-pins on the feed chain can be displaced transversely results in a relatively complicated and therefore costly and troubleprone construction of the machine. The object of the invention therefore is in the case of a multispot welding machine of the kind described to enable stretching of the wires taut as necessary in the welding zone after loose laying of them between the cooperating rows of deflector-pins and relieving the stretch in the wires after the welding of the mesh web, without an arrangement of the deflector-pins being displaceable on the feed-chains being necessary.

In accordance with the invention, in a machine of the kind described, the endless feeders circulate in a common plane which is parallel with the plane of producion of the web, the deflector-pins project substantially perpendicularly from the common plane, and the working runs of the two feeders have, in the neighbourhood of the welding zone, a greater separation from one another than before and beyond the zone.

In the case of a particularly simple and therefore preferred construction the feeders are formed as chains, joint pins connecting adjacent links of the chain being prolonged to one side of the chain into deflector-pins or into fastening devices for exchangeable deflector-pins.

Since with the stretching of the wires in the welding zone a tilting torque is exerted on the deflector-pins, the joint pins carry rollers advantageously on both sides of the chain, which bear against guide-faces of chain-guides which, with respect to the axes of the pins, are opposed to one another so as to counteract the welding reaction tending to tilt the deflector-pins and which control the mutual separation between the two working runs of the chains.

Beyond the welding zone of the machine a reeler roll for the finished mesh web, which at the same time withdraws the finished web from the deflector-pins, may be arranged above the plane of production of the mesh when the common plane is horizontal and the deflector-pins extend upwards.

Figure 2:
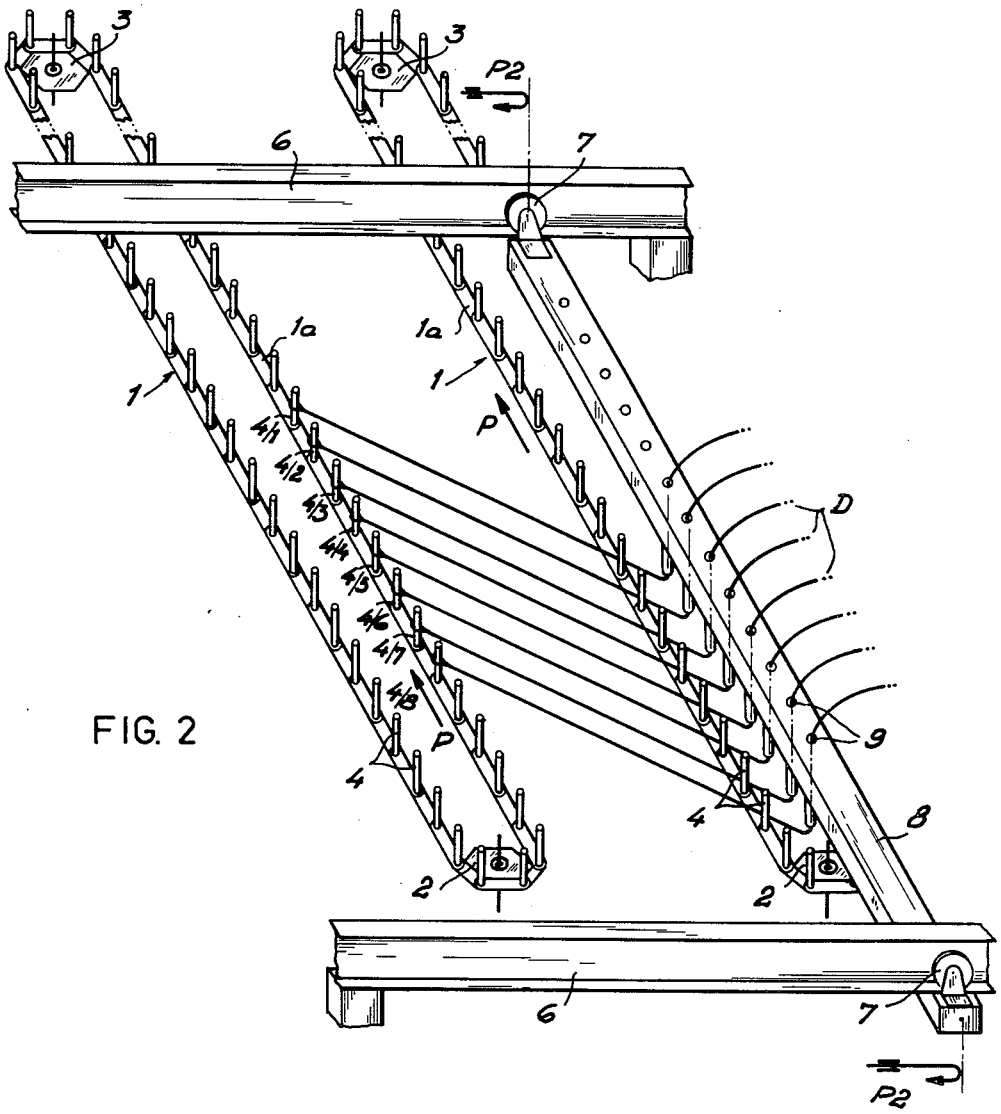
Figure 3:
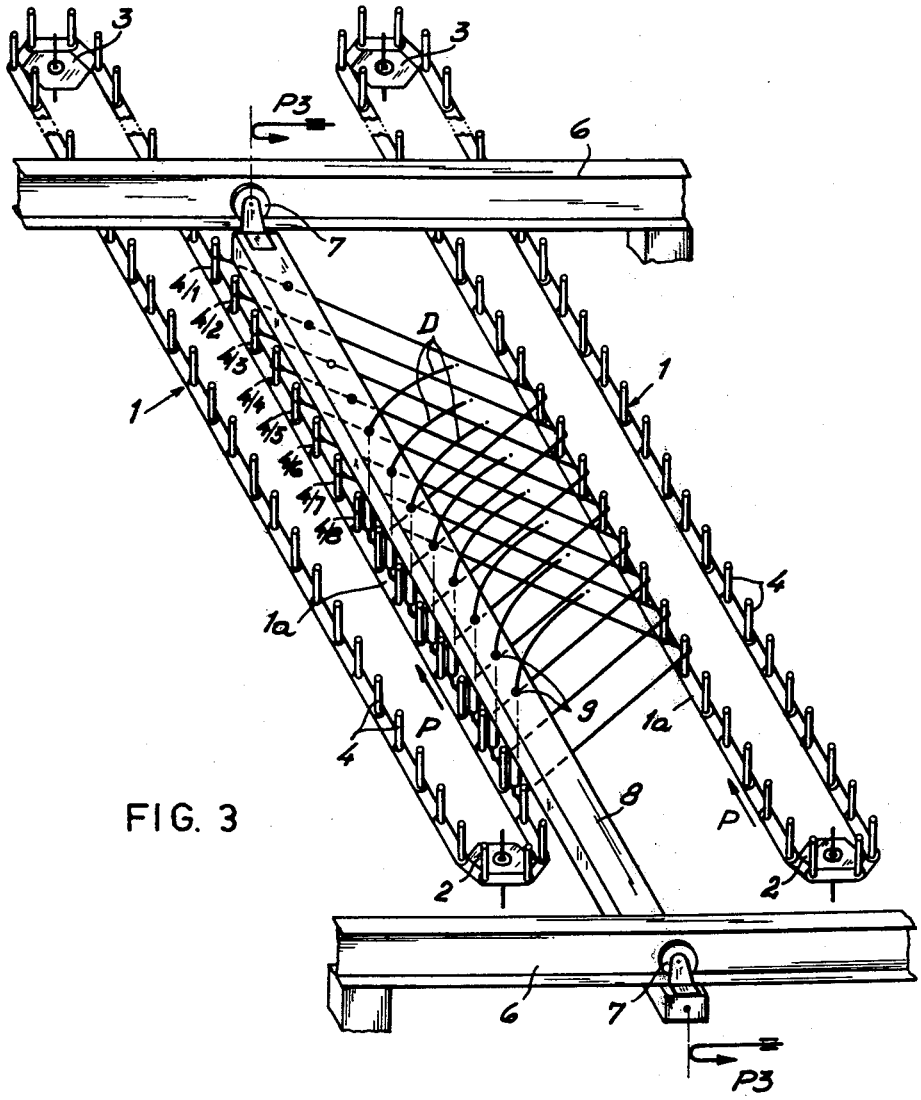
Figure 4:
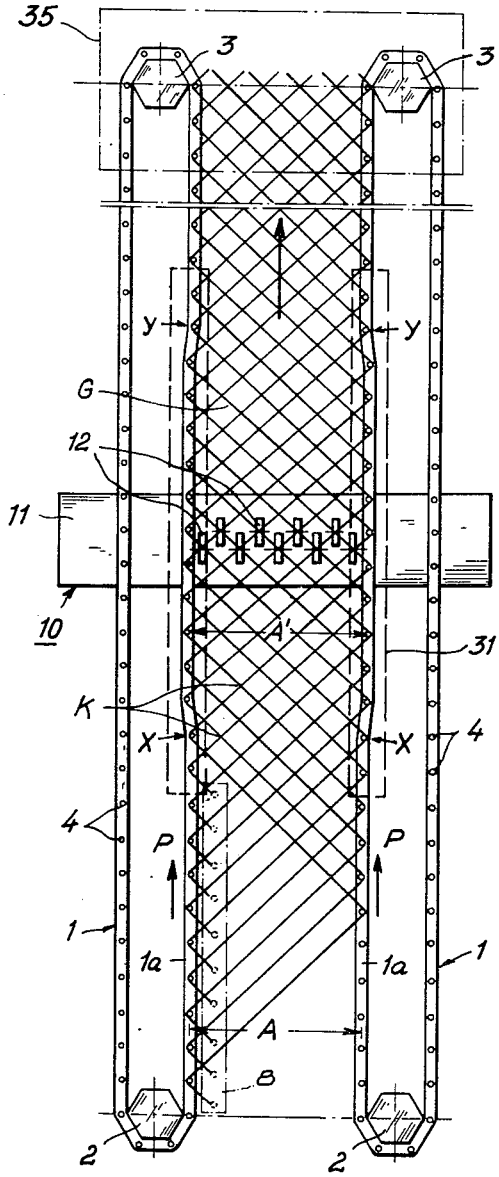
Figure 5:
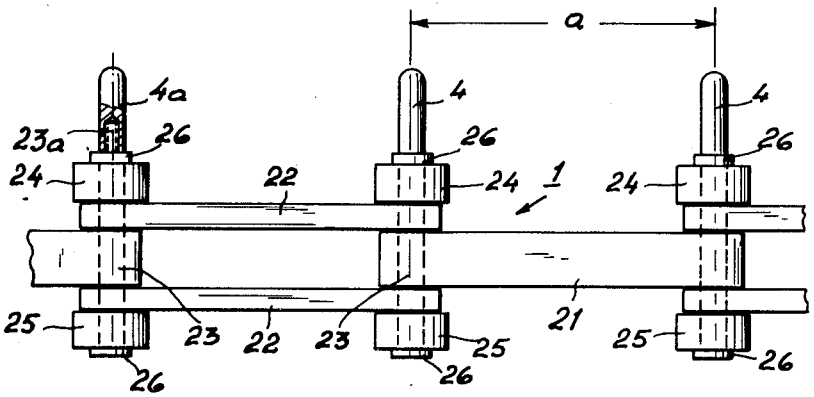
Figure 7:
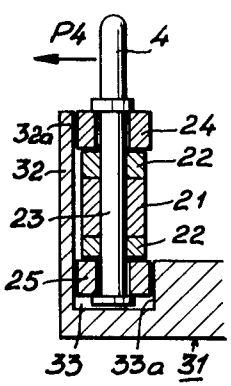
Figure 6:
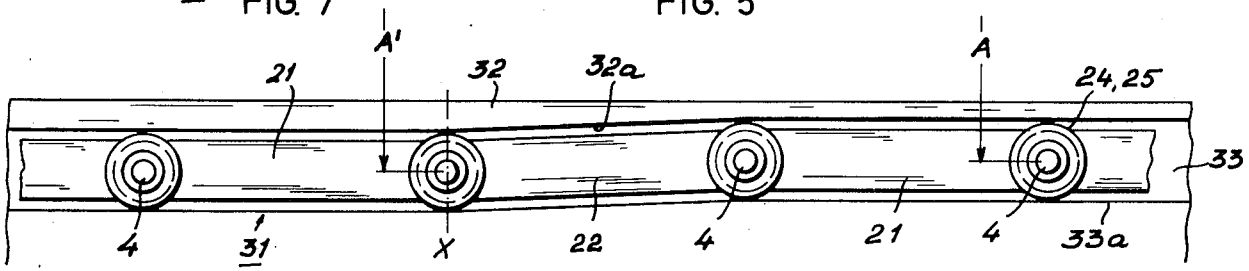

An example of a machine constructed in accordance with the invention is illustrated in the accompanying drawings, in which:

FIGS. 1 to 3 explain in three different phases of operation illustrated in plan axonometrically, the cooperation of the wire-layer with the feed-chains and deflector-pins of the machine;

FIG. 4 shows a diagrammatic plan with the wire-layer and the upper welding-electrodes omitted; and, FIGS. 5, 6, and 7 show respectively a side elevation of a feed-chain, a plan of the chain guide and a cross-section through the chain and the chain guide.

As may be understood from FIGS. 1 to 4, endless feed-chains 1 are arranged at the two sides of the welding machine, the orbits of which lie in a common plane which runs parallel with the plane of production of the mesh, which in FIG. 4 is parallel with the plane of the drawing. Each chain is looped round two sprockets 2,3, one at least of which is driven. The chain wheels 2,3 are supported firmly in a machine frame which is not shown.

From the feed-chains 1, perpendicular to their orbital plane, deflector-pins 4 project upwards, the mutal separation *a* of which corresponds with a diagonal of the wire mesh to be produced. The inner strands 1*a* of both feed-chains 1 run parallel with one another and are moved in sympathy in the direction of the arrow P. The mutual separation A of the rows of deflector-pins 4 carried by the inner strands 1*a* of the chains correspond with the width of the mesh web G to be produced.

On two bearer rails 6 running across the machine; a wire-layer 8 is arranged to be able to travel in the transverse direction by means of rollers 7. This wire-layer has the form of a beam in which is formed a row of guide-eyes 9 which have the same mutual separation *a* as the deflector-pins 4 on the feed-chains 1. The wire-layer, by driving means (not shown) synchronized with the drive of the feed-chains 1, is set in motion to and fro transversely at such a speed that from a starting position at the left-hand feed-chain strand 1*a* in FIG. 1, after the to and fro motion across the machine, it returns to the starting position again just at the instant at which the stand 1*a* of the chain 1 has moved onwards by a number of pin-pitches *a* which corresponds with the number of wires laid by the wire-layer.

The wires D are drawn off stock reels, passed through the guide-eyes 9 in the wire-layer 8 and at the start of production of a mesh web fastened by their ends in accordance with FIG. 1 to a corresponding number of deflector-pins 4. In the example illustrated the wire-layer 8 exhibits eight guide-eyes 9 and the wires D passing through these eyes are fastened to eight successive deflector-pins 4 which are designated in FIGS. 1 by 4/1 to 4/8.

After the starting phase of the production of a mesh web as shown in FIG. 1, the wire-layer 8, by transverse displacement in the direction of the arrow P1, arrives in the position shown in FIG. 2, on the far side of the inner strand 1*a* of the right-hand feed-chain 1, whilst at the same time the deflector-pins 4/1 to 4/8 securing the ends of the wires on the left-hand feed-chain advance in the direction of feed by the distance 4*a*. The wire-layer 8 in the phase of operation as FIG. 2 reverses its direction of motion in accordance with the arrow P2, so that the wires get looped round deflector-pins 4 on the inner strand of the right-hand feed-chain and are led back to the inner strand of the left-hand feed-chain in a zigzag as shown in FIG. 3, in order, after a total advance of this strand of chain by the distance 8*a*, to be looped in a similar manner by a movement of the wire-layer 8 in the direction of the arrow P3, round the next eight deflector-pins 4 on this strand of the chain 1.

The points of cross K of the wires in the mesh web G resulting from this, upon passing through the welding zone 10 which is not illustrated further in FIGS. 1 to 3 but may be understood from FIG. 4, and in which there are, e.g. below the plane of production of the mesh a panel-like counter electrode 11 and above this plane two rows of roller electrodes 12 offset with respect to one another, are welded in known manner by electrical resistance welding.

In order to stretch the wires D which have been laid by the wire-layer 8 loosely round the deflector-pins 4 on the strands 1*a* of the two feed-chains 1, in the welding zone, and thus to bring them exactly in the correct position for welding, in accordance with the invention the inner strands 1*a* of the two feed-chains 1 are in accordance with FIG. 4 deflected locally outwards in the course of their motion of advance, so that the normal separation A of the rows of deflector-pins 4 which are carried by the strands of the chains and which define the mesh width, is increased in the welding zone to the value A'. For achieving this local displacement of the inner strands 1*a* of chain appropriate chain-guides 31 provided between the points X and Y on the strands of chain.

FIG. 5 shows a preferred form of the feed-chain as side-bar chains and FIGS. 6 and 7 show in plan and in side elevation respectively suitable chain-guides.

In the case of the side-bar chain shown in FIG. 5 in each case a single chain link 21 and two chain links 22 arranged at the side of it are connected together by joint pins 23. These joint pins 23 are extended to one side and thus form the deflector-pins 4 which have the separation *a* from one another. Besides this, on each joint pin 23 on both sides of the chain links 22, guide rollers 24,25 are supported, which are secured suitably by retaining rings 26.

Chain-guides of the kind shown in FIGS. 6 and 7, which are arranged at the parts lying between the points X and Y in FIG. 4, of the inner strands 1*a* of feed-chains 1 as FIG. 5, serve, as already mentioned, the purpose of increasing locally the separation between the rows of pins 4 carried by these strands of the chains, and are so formed that the pins in this zone get effectively braced against tilting which would otherwise occur because of the increased forces of reaction from the stretched wires.

The chain-guide 31 illustrated has essentially the form of a rail with a guide-cheek 32 and a recess 33. The guide-cheek 32 lies in each case on the inside of the inner strand 1*a* of the feed-chain 1 in question, which is illustrated in FIG. 7 in cross-section in the region of its joint pin 23. The upper roller 24 bears against the inner face 32*a* of the guide-cheek 32 and the lower roller 25 bears against the wall face 33*a* of the recess 33, which is opposite with respect to the axis of the joint pin 23, in such a way that the deflector-pin 3 formed by the prolonged pin 23 cannot tilt in the direction of the arrow P4 under the action of the force of reaction from the wire being stretched by it.

As may be understood from FIG. 6, the guide-cheek 32 of the chain guide is thicker from the point X onwards than before this point, whereby the strand 1*a* of chain lying against it also gets displaced outwards from this point on, so that in the cooperation of both strands 1*a* of chain the original separation A between the two cooperating rows of deflector-pins 4 is increased to the higher value A'.

Instead of the side-bar chain illustrated other chains or even belts may be employed, in which the deflector-pins are appropriately anchored.

The width of the mesh web may be altered in a simple manner if the separation A between the two rows of cooperating deflector-pins is altered by increasing the mutal separation between the supporting shafts of the guide sprockets of the two feed-chains and the amplitude of the operating motion of the wire-layer is correspondingly increased.

In the event that the wire pattern is to remain unaltered, a correspondingly greater number of wires must in that case be laid. The wire-layer 8 advantageously has a number of guide-eyes 9 at equal pitch, which number is correspondingly correlated the maximum contemplated width of mesh web to be produced.

Under certain circumstances it may be recommendable to make the deflector-pins exchangeable. For this purpose the deflector-pin 4*a* (at the left of FIG. 5) may, e.g. be screwed onto a threaded pin 23*a* which is formed in one piece with the threaded pin 23.

Since the finished mesh web, because of the deflector-pins projecting into the mashes, cannot be withdrawn from the two feed-chains in the direction of feed, a driven reeler roll 35 is advantageously provided above the plane of production of the mesh as indicated in FIG. 4, which pulls the finished mesh upwards off the deflector-pins.

We claim:

1. In a multispot welding machine for producing an elongated wire mesh web, the machine being of the type having means for forming and longitudinally advancing the mesh web in a production plane, including two circulating endless feeders having operating runs defining respective longitudinally extending margins of the wire mesh web, a plurality of deflector-pins respectively connected to the feeders for circulation therewith, and a wire-layer mounted for reciprocation transversely of the elongation of the wire mesh web between, and adapted to so lay a plurality of wires around the deflector-pins during their circulation with the operating runs of the feeders, that the respective wires extend in two arrays askew to the elongation of the wire mesh web and cross each other at a multitude of crossing points, and means for welding the wires to one another at their crossing points at a welding zone, the improvement comprising, in combination:

means for mounting the feeders for circulation along the production plane of the wire mesh web, means for so supporting the deflector-pins on the feeders as to extend substantially normal to the production plane of the wire mesh web, and two guiding arrangements, each of which guides at least the operating run of one of the feeders for movement in a path which has a greater transverse spacing from the path of movement of the operating run of the other feeder in the vicinity of the welding zone, than ahead and behind the welding zone, as defined in the direction of advancement of the wire mesh web.

2. The improvement according to claim 1, wherein each of the feeders is a chain including a plurality of successive links, and wherein each of said deflector-pins has a connecting portion which interconnects the respective successive links, and a projecting portion which extends from said connecting portion beyond the interconnected successive links, and across the production plane.

3. The improvement according to claim 2, wherein each of said deflector-pins further includes a deflecting portion which is exchangeably mounted on said projecting portion of said deflector-pin.

4. The improvement according to claim 2, and further comprising two rollers for each for said deflector-pins, each of said rollers being mounted on the respective deflector-pin at one side of the chain and so bearing against the respective guide arrangement as to maintain the respective deflector-pin substantially normal to the production plane even at the welding zone, and to counteract any increased tendency of the respective wire to tilt the respective deflector-pin at the welding zone.

5. The improvement according to claim 1, and further comprising means for so mounting a takeup reeler roll for the finished wire mesh web that the finished wire mesh web approaches said takeup reeler roll in a takeup plane which encloses an angle with the production plane, whereby the finished wire mesh web is withdrawn from the deflector-pins as it proceeds in the takeup plane toward the takeup reeler roll.

6. The improvement according to claim 5, wherein said production plane is horizontal, and said deflector-pins extend upwardly from said feeders toward and across said production plane, and wherein said takeup plane extends upwardly from said production plane as defined in the advancement direction of the wire mesh web.

* * * * *